US005951193A

United States Patent [19]

Yamamoto et al.

[11] Patent Number: 5,951,193

[45] Date of Patent: Sep. 14, 1999

[54] MECHANISM FOR CONNECTING ORNAMENTAL PARTS OF WRIST WATCH

[75] Inventors: Akio Yamamoto; Taro Tanaka; Haruyuki Shimayama; Shunichi Kojima; Noboru Hosokawa, all of Tokyo, Japan

[73] Assignee: Kabushiki Kaisha Hattori Seiko, Tokyo, Japan

[21] Appl. No.: 08/601,935

[22] Filed: Feb. 15, 1996

[30] Foreign Application Priority Data

Feb. 20, 1995 [JP] Japan ..... 7-056718

[51] Int. Cl.[6] ..... F16C 11/00

[52] U.S. Cl. ..... 403/154; 403/326; 24/265 B; 368/282

[58] Field of Search ..... 403/157, 153, 403/154, 155, 150, 161, 163, 363, 326; 24/265 B, 265 WS; 63/21; 224/164; 368/282

[56] References Cited

U.S. PATENT DOCUMENTS

| | | | |
|---|---|---|---|
| 1,792,931 | 2/1931 | Roy | 24/265 B X |
| 2,229,134 | 1/1941 | Sauer, Jr. | 24/265 WS X |
| 2,536,007 | 12/1950 | Milner | 24/265 B |
| 3,565,304 | 2/1971 | Kalinsky | 24/265 WS X |
| 3,740,804 | 6/1973 | Levinger | 24/265 B X |
| 3,976,233 | 8/1976 | Cobelli | 24/265 B X |
| 4,113,397 | 9/1978 | Snyder | 403/154 |
| 5,042,115 | 8/1991 | Dumas et al. | 24/265 WS X |
| 5,398,218 | 3/1995 | Munnier et al. | 224/164 X |

FOREIGN PATENT DOCUMENTS

| | | | |
|---|---|---|---|
| 400206 | 12/1990 | European Pat. Off. | 368/282 |
| 2686713 | 7/1993 | France | 368/282 |
| 656512 | 7/1986 | Switzerland | 24/265 WS |
| 664267 | 2/1988 | Switzerland | 224/164 |

*Primary Examiner*—Harry C. Kim
*Attorney, Agent, or Firm*—Stroock & Stroock & Lavan LLP

[57] ABSTRACT

A mechanism for connecting ornamental parts of wrist watches that permit easily connecting and disconnecting ornamental parts without using any special tool and without marring the appearance of wrist watches. A stepped pin is inserted in a larger-diameter bore of a cocoon-shaped ring fitted in an end piece and a bore in a watch casing. Then, a smaller-diameter part of the stepped pin is moved into a smaller-diameter bore by pulling the watch casing and a band longitudinally. With the stepped pin thus securely held in place, the watch casing and band are firmly connected.

22 Claims, 15 Drawing Sheets

MECHANISM FOR CONNECTING ORNAMENTAL PARTS OF WRIST WATCH

BACKGROUND OF THE INVENTION

This invention relates to mechanisms for connecting ornamental parts of wrist watches, such as casings, bands, buckles and collapsible fasteners, and more particularly to mechanisms for connecting ornamental parts of wrist watches without using any special coupling and de-coupling tool.

Generally, the casing and the band or components thereof, or the band and the buckle or other ornamental parts are connected together by means of spring bars or connecting means comprising pins and C-rings. In connecting or disconnecting such ornamental parts, tools suited for such connecting devices are used.

Any person who wants to change the band of a wrist watch according to the occasion or increase or decrease the number of links according to the size of the wrist has had to ask the watchmaker to make the desired change. If inexperienced persons make such changes on their own, there is the risk of damaging ornamental parts.

Several means for changing ornamental parts without using any special tool have been proposed.

The one disclosed in Japanese Provisional Patent Publication No. 111707 of 1984 features a small knob provided at an end of a lever. The knob protrudes above the watch band to permit manual adjustment of the lever. However, the knob involves the risks of not only marring the appearance but also damaging the skin and clothes. The one disclosed in Japanese Provisional Utility Model Publication No. 18370 of 1980 features an eccentric cam provided on the watch band proper. The eccentric cam is not only complicated in construction but also can damage the finger when rotating. The one disclosed in Japanese provisional Utility Model Publication No. 153211 of 1985 has a guide hole and a slot in the back of the connecting part of the watch band so that a spring bar can be fitted into the slot through the guide hole. This mechanism is unsightly and readily comes off.

SUMMARY OF THE INVENTION

An object of this invention is to provide a new mechanism for connecting ornamental parts of a wrist watch that permits easy replacement of ornamental parts without using any special tools and damaging the appearance.

Another object of this invention is to provide a simple connecting mechanism comprising a stepped pin and a cocoon-shaped ring having a larger-diameter bore and a smaller diameter bore whose width is somewhat smaller than the length of a smaller-diameter part of the stepped pin on both sides of a constricted part. The cocoon-shaped ring is provided at an end of an ornamental part. The stepped pin inserted from one end of the larger-diameter bore is moved into the smaller-diameter bore by pulling the ornamental part longitudinally. The stepped pin securely held in place firmly connect the ornamental part to a watch casing or another ornamental part. This connecting mechanism easily connects and disconnects a watch casing and a watch band, links of a watch band, and other ornamental parts for wrist watches without using any special tool. Contained in ornamental parts, the connecting mechanism according to this invention also avoids marring the appearance of wrist watches.

To achieve the above object, a mechanism for connecting ornamental parts of a wrist watch comprises a stepped pin having a smaller-diameter part at least in the middle of the length thereof to connect together ornamental parts of a wrist watch and a ring that is cocoon-shaped in cross-section, provided on one of the ornamental parts, and having a constricted part that resiliently alters the shape to allow the smaller-diameter part of the stepped pin to pass thereover, a larger-diameter bore to accommodate the larger-diameter part of the stepped pin provided on one side of the constricted part, and a smaller-diameter bore whose diameter is slightly smaller than the diameter of the smaller-diameter part of the stepped pin to be fitted therein that is provided on the other side of the constricted part.

Another connecting mechanism according to this invention comprises a stepped pin to connect ornamental parts for a wrist watch that has a smaller-diameter part at least in the middle of the axis thereof and a cocoon-shaped ring provided at one end of one of the ornamental parts to be connected and having bores of size large enough to accommodate a larger-diameter part of the stepped pin on both sides of a constricted part that resiliently alters shape and a projection bent inward in one of the bores to restrict the motion of the stepped pin by engaging with the smaller-diameter part thereof, the width of the projection being somewhat smaller than the length of the smaller-diameter part of the stepped pin.

Still another connecting mechanism according to this invention comprises a stepped pin to connect ornamental parts for a wrist watch that has a smaller-diameter part at least in the middle of the axis thereof and a cocoon-shaped ring provided at one end of one of the ornamental parts to be connected and having a larger-diameter bore to accommodate a larger-diameter part of the stepped pin and a smaller diameter bore to accommodate the smaller-diameter part of the stepped pin, with a connecting space whose width is equal to the diameter of the smaller-diameter part provided therebetween.

BRIEF DESCRIPTION OF DRAWINGS

FIGS. 9A and 9B are a perspective and a cross-sectional view of the cocoon-shaped ring, whereas FIG. 9C is a perspective view of a stepped pin inserted in the ring.

FIGS. 10A to 10D are an exploded, a perspective, a cross-sectional view of the ring and a view showing the ring fitted in an end piece.

FIGS. 12A to 12C are a perspective and a cross-sectional view and a view showing the ring fitted in an end piece.

FIGS. 13A and 13B are perspective views of a cocoon-shaped ring and a stepped pin. FIG. 13C shows the ring fitted in an end piece. FIG. 13D shows the force exerted by the stepped pin on the bent end of the ring. FIG. 13E shows a modification of the cocoon-shaped ring.

FIGS. 14A and 14B are perspective views of a cocoon-shaped ring and a stepped pin. FIGS. 14C and 14D are cross-sectional views of the cocoon-shaped ring and the same ring fitted in an end piece.

FIGS. 15A to 15D are perspective views of a cocoon-shaped ring and a stepped pin and cross-sectional views of the cocoon-shaped ring and the same ring fitted in an end piece.

FIGS. 16A to 16C are perspective views of a cocoon-shaped ring and a stepped pin and a cross-sectional view showing the same cocoon-shaped ring fitted in an end piece.

PREFERRED EMBODIMENTS OF THE INVENTION

Some preferred embodiments of this invention will be described in the following.

Figure 1:
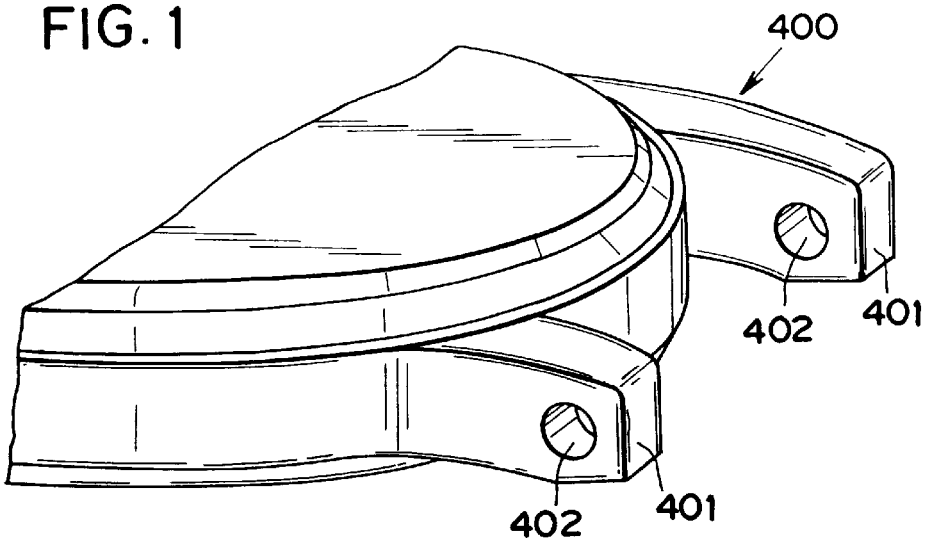
FIG. 1 is an exploded perspective view showing an embodiment of this invention for connecting a watch casing to a watch band.
Figure 1:
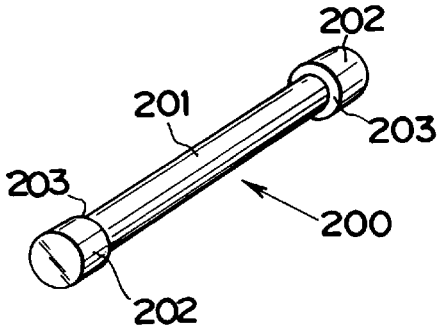
Figure 1:
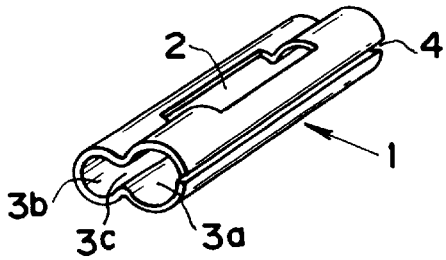
Figure 1:
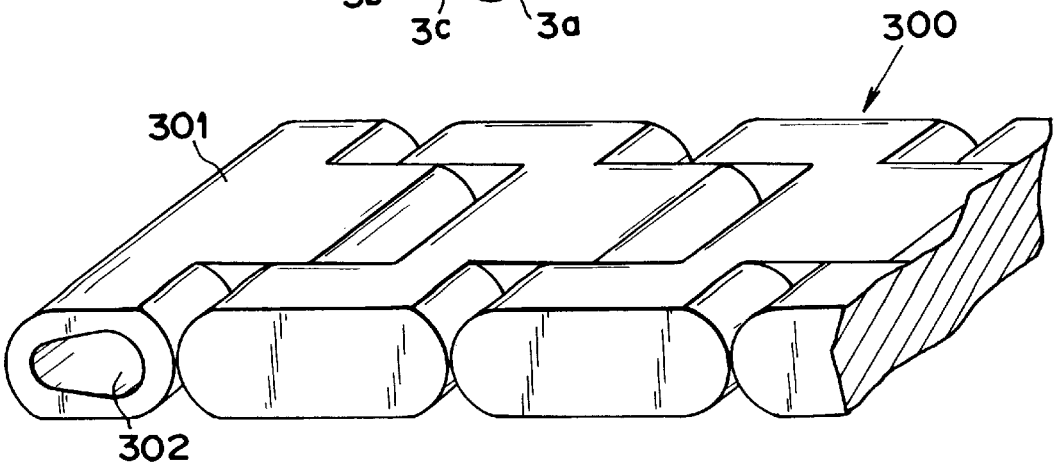

FIG. 1 is an exploded perspective view of a mechanism for connecting a metal band to a wrist watch having dual lugs embodying the principle of this invention.

This mechanism comprises a ring cocoon-shaped in cross-section 1 and a stepped pin 200. The cocoon-shaped ring 1 is a member that keeps the stepped pin 200 in position. The cocoon-shaped ring 1 is designed to be fitted in a ring-accommodating bore 302 provided in a metal band 300 and has a length substantially equal to the width of the metal band. The ring 1 is made of a sheet metal that is formed into a cocoon-like shape in cross-section, with a larger-diameter bore 3*a* and a smaller-diameter bore 3*b* provided on both sides of a constricted part 3*c* in the middle. The larger-diameter bore 3*a* has an inside diameter that is large enough to allow the larger-diameter part 202 of the stepped pin 200 to loosely pass therethrough, whereas the smaller-diameter bore 3*b* has a diameter that is substantially equal to the diameter of the smaller-diameter part 201 of the stepped pin 200. The constricted part 3*c* has an opening whose width is smaller than the diameter of the smaller-diameter part 201.

This cocoon-shaped ring 1 is bent so that mating ends 4 are formed on the outer side of the larger-diameter bore 3*a*. A slot 2 opening into both the larger- and smaller-diameter bores 3*a* and 3*b* is cut in the middle of the length thereof to facilitate the insertion of the stepped pin 200 into the cocoon-shaped ring 1 where conformance to close tolerance on applied force is required.

The stepped pin 200 is a member for connecting a watch casing 400 and a metal band 300. The stepped pin 200 has a smaller-diameter part 201 in the middle thereof, the length of which being equal to the width of the cocoon-shaped ring 1. Larger-diameter parts 202 formed at both ends of the stepped pin 200 are inserted into holes 402 provided in lugs 401 on the watch casing 400. An elevation 203 between the smaller- and larger-diameter parts 201 and 202 restricts the longitudinal motion of the cocoon-shaped ring 1.

The diameter of the larger-diameter part 202 of the stepped pin 200 is smaller than the inside diameter of the holes 402 by approximately 0.05 mm so as to allow the stepped pin 200 to drop off when it is turned upright, without using any special tool, when the need to separate the metal band 300 from the watch casing 400 arises. This diameter difference also permits using the stepped pin 200 of one design with many different types of watch casings 400.

The watch casing 400 and metal band 300 are connected together as described below.

First, the cocoon-shaped ring 1 is inserted in a slot 302, with one end thereof somewhat constricted, provided in an end piece 301, with the smaller-diameter bore 3*b* positioned in the constricted part of the slot. With the metal band 300 positioned substantially perpendicularly to the watch casing 400, the end piece 301 is placed between a pair of lugs 401. After matching the larger-diameter bore 3*a* to the holes 402, the stepped pin 200 is inserted therethrough from one of the holes 402.

While the watch casing 400 is held with one hand, the metal band 300 is pulled lengthwise with the other hand, whereupon the smaller-diameter part 201 moves into the smaller-diameter bore 3*b* by resiliently opening up the constricted part, thus completing the mounting.

With the cocoon-shaped ring 1 thus secured between the elevations 203 on the stepped pin 200, the longitudinal motion of the stepped pin 200 is restricted to establish a firm connection between the watch casing 400 and metal band 300.

If one of the holes 402 on the watch casing 400 is a blind hole, the stepped pin 200 can be positioned easily by pressing the end of one large-diameter part 202 against the closed end of the blind hole.

The tensile force that usually acts on the watch on the wrist keeps the casing 400 and metal band 300 in a rigid connection. The click produced by the constricted part 3*c* on returning to its original state when the smaller-diameter part 201 has fitted in the smaller-diameter bore 3*b* facilitates the confirmation of the completion of assembling.

In disassembling, the metal band 300 and watch casting 400 are positioned substantially perpendicularly to each other. While the watch casing 400 is held with one hand, the metal band 300 is pressed lengthwise with the other hand, whereupon the smaller-diameter part 201 of the stepped pin 200 moves into the larger-diameter bore 3*a* by resiliently opening up the constricted part 3*c*. By turning the casing 400 and band 300 upright in this condition, the stepped pin 200 drops off by its own weight, without requiring any tool. Tapering of the elevations 203 will further facilitate the removal of the stepped pin 200.

Placing the metal band 300 and watch casing 400 substantially perpendicularly to each other before fitting and removing the stepped pin 200 is a necessary step to allow the metal band 300 to move freely in the direction of the thickness of the watch casing 400. When the metal band 300 is repositioned to extend parallel to the watch casing 400 on completion of assembling, the metal band 300 is held between the lugs, with free movement inhibited. This permits providing a normal appearance to the watches with this type of metal bands, with the amount of clearance between the lugs on the watch casing 400 and the end piece 301 kept equal to that on ordinary watches. Even when a compressive force suddenly acts on the watch worn around the wrist, the end piece 301 remains in position without coming off the watch casing 400.

The length of the slot 2 in the cocoon-shaped ring 1 is varied depending on the length of the cocoon-shaped ring 1. This permits using sheet metal of a fixed thickness regardless of the width of the band. The amount by which the cocoon-shaped ring 1 alters its shape when the stepped pin 200 is pushed in is proportional to the third power of sheet thickness and to the first power of sheet width. Therefore, it is more rational to vary the sheet width, rather than to vary the sheet thickness.

The mating ends 4 formed on one side of the larger-diameter bore 3*a* of the cocoon-shaped ring 1 of the first embodiment may also be provided on the side of the smaller-diameter bore 3*b* or elsewhere. Also, the cocoon-shaped ring 1 may be made not only of sheet metal but also of metal tube.

This embodiment is applicable to all types of metal bands including those of solid, semi-solid, wrapped and helically wound metal. It is also applicable to bands of synthetic resins.

Figure 2:
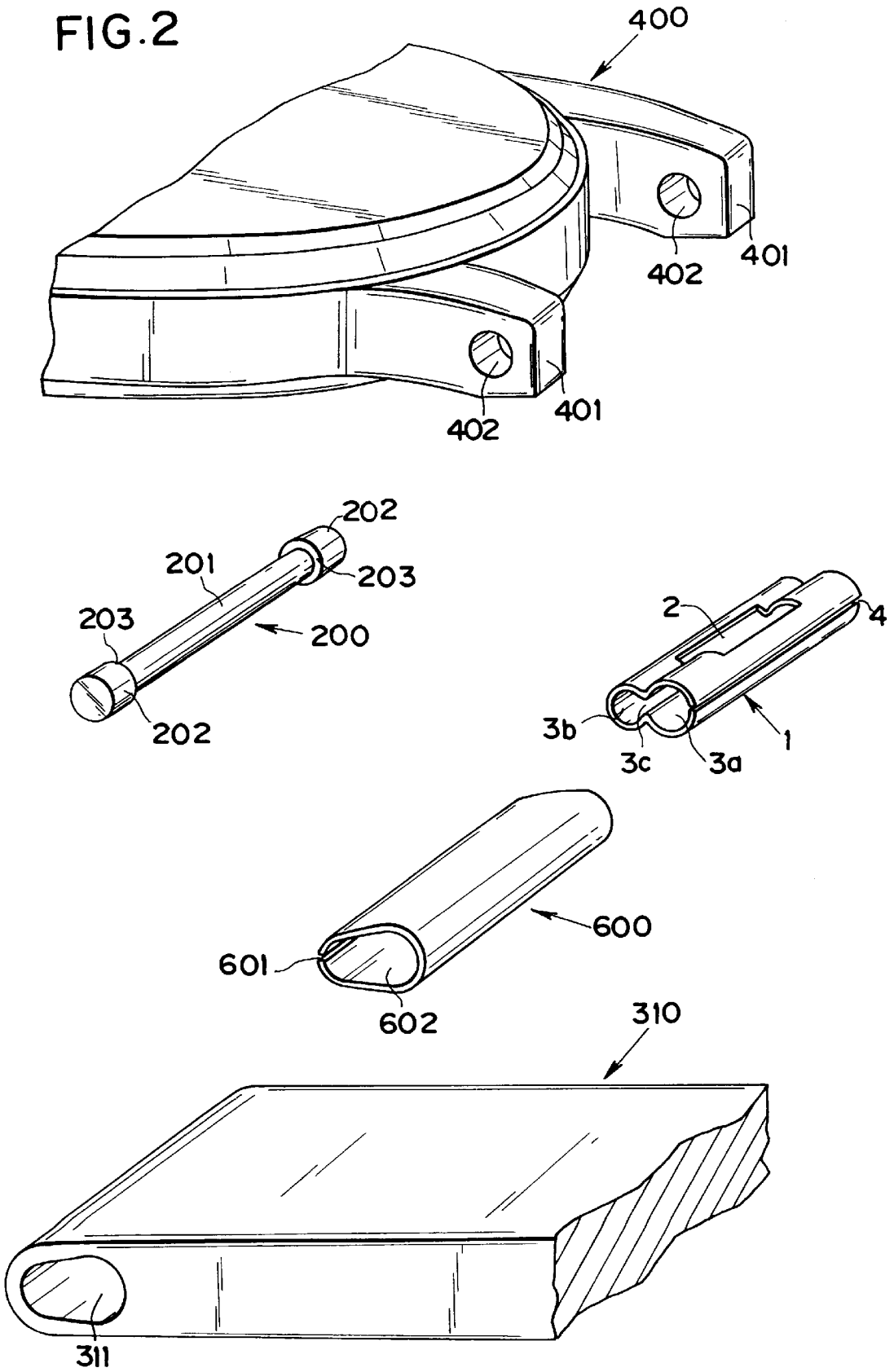
FIG. 2 is an exploded perspective view showing another embodiment of this invention.

FIG. 2 is an exploded perspective view showing a second embodiment of this invention, or more specifically a mechanism for attaching a leather band 310 to a watching casing 400 having two lugs.

In this embodiment, the deformation of the cocoon-shaped ring 1 resulting from the insertion of a stepped pin 200 produces no effect on the leather band 310. The cocoon-shaped ring 1 similar to the one used in the first embodiment is inserted first in a spacer 600 having a substantially similar cross-section and then in an opening 311 in the leather band 300, with the smaller-diameter bore 3*b* positioned in the constricted part of the opening. This embodiment is also applicable to bands of synthetic resins, such as urethanes and vinyls, and clothes.

Figure 3:
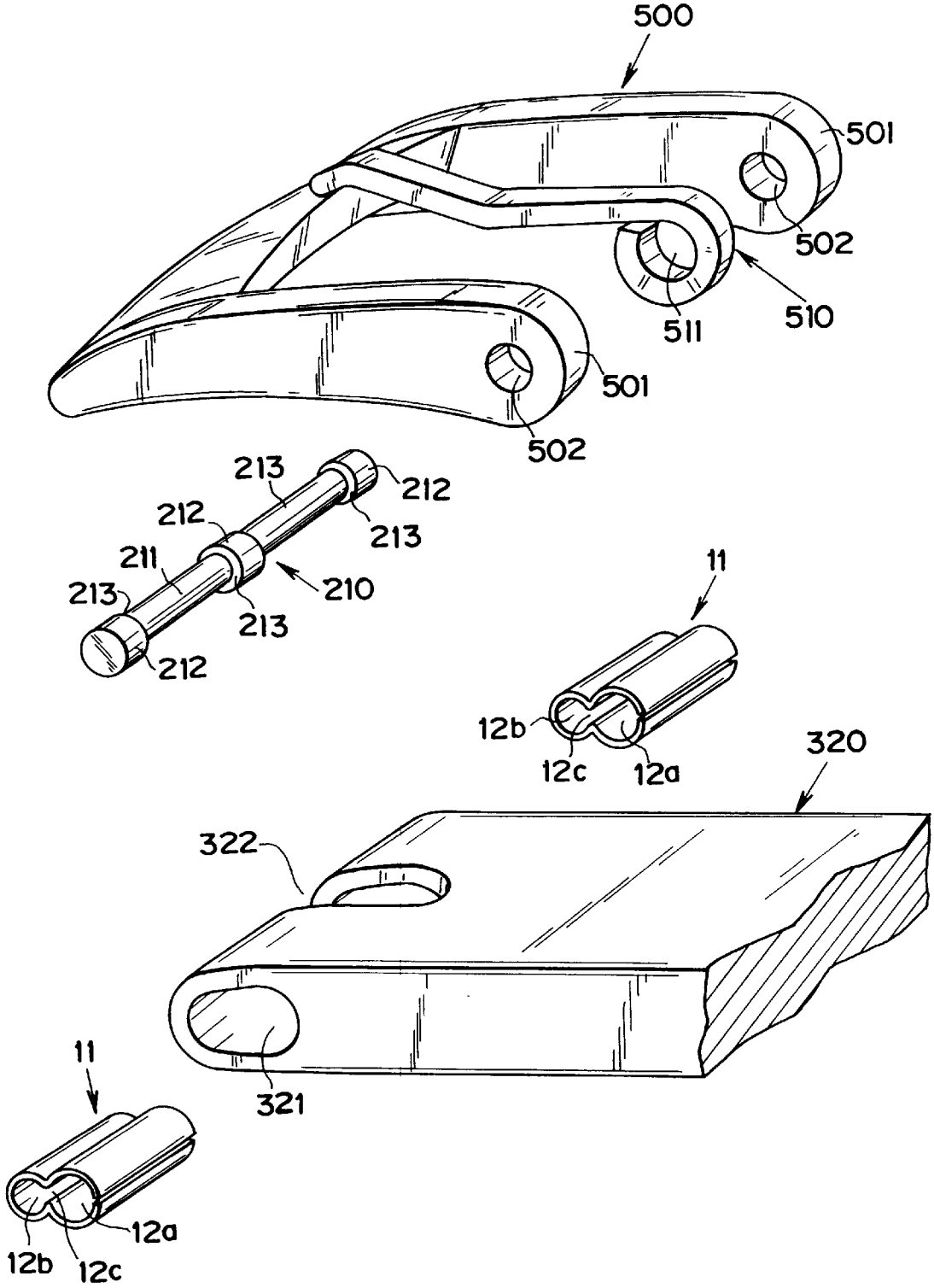
FIG. 3 is an exploded perspective view showing an embodiment of this invention for connecting a buckle to a watch band.

FIG. 3 is an exploded perspective view of a third embodiment of this invention that attaches a buckle to a leather band.

This embodiment comprises two cocoon-shaped rings 11 whose length is less than half the width of the band and a stepped pin 210. Each of the cocoon-shaped rings 11 is made of sheet metal and comprises a larger-diameter bore 12*a*, a smaller diameter bore 12*b* and a constricted part 12*c*.

The stepped pin 210 has larger-diameter parts 212 at both ends and the center thereof that can be passed through bores 502 and 511 provided in the rims of a buckle 500 and a movable tongue 510, with the intermediate parts forming smaller-diameter parts 211 whose length is substantially equal to the width of the cocoon-shaped rings 11.

The end of the leather band 320 where the buckle 500 is to be attached is formed into openings 321 to accommodate the cocoon-shaped rings 11. Because the buckle 500 and leather band 320 are not frequently connected or disconnected, the cocoon-shaped rings 11 are inserted directly into the openings 321 without using the spacer 600 mentioned earlier. Reference numeral 322 designates a recess provided at an end of the leather band 320 to accommodate a movable tongue 510 at the center thereof.

This embodiment has no slot 2 that is provided in the cocoon-shaped ring 1 because the buckle 500 is not frequently connected or disconnected and, therefore, conformance to close tolerance on applied force is not required.

Figure 4:
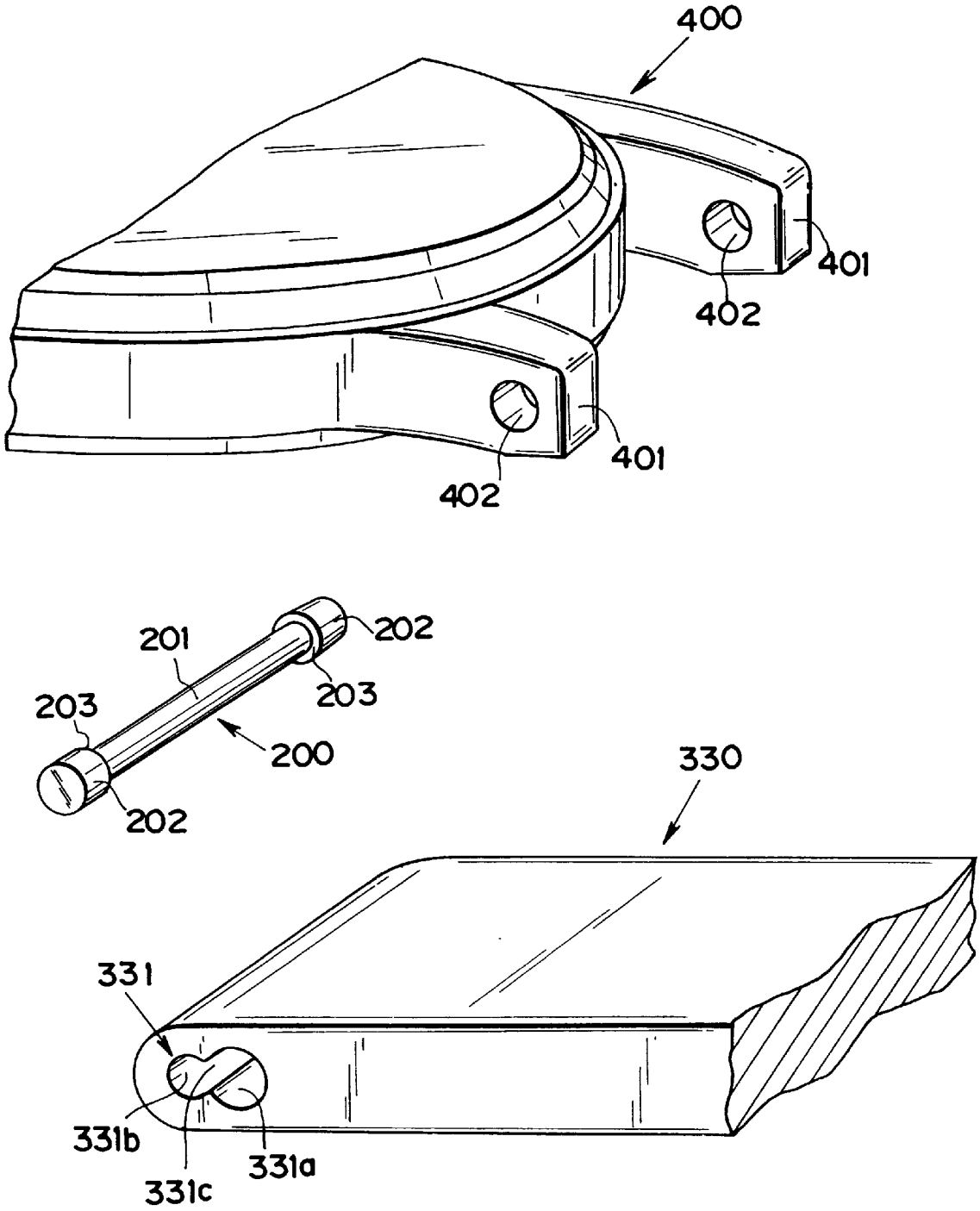
FIG. 4 is an exploded perspective view showing another embodiment of this invention.

FIG. 4 shows an embodiment of this invention used for attaching an urethane band 330 directly to a watch casing 400 having two lugs.

A cocoon-shaped bore 331 comprising a larger-diameter bore 331*a*, a smaller-diameter bore 331*b* and a constricted part 331*c* is provided at the end of the urethane band 330 that is to be connected to the watch casing 400, with the smaller-diameter bore 331*b* placed in a position to face the watch casing. A stepped pin 200 having a larger-diameter part 202 and a smaller-diameter part 201 is inserted therein.

The watch casing 400 and urethane band 330 are connected together by first inserting the urethane band between lugs 401 with the urethane band 330 positioned substantially perpendicularly to the watch casing 400. After matching the larger-diameter bore 331*a* with holes 402, the stepped pin 200 is pressed inside. When the urethane band 330 is pulled lengthwise, the smaller-diameter part 201 moves into the smaller-diameter bore 331*b* by opening up the constricted part 331*c* because the urethane band 330 is elastic, thereby completing the assembling.

This embodiment is for connecting the watch casing 400 to the urethane band 330. This invention is also applicable to the connection of the urethane band 330 and a buckle by providing a larger-diameter bore 331*a*, a smaller-diameter bore 331*b* and a constricted part 331*c* at one end of the urethane band 330.

Figure 5:
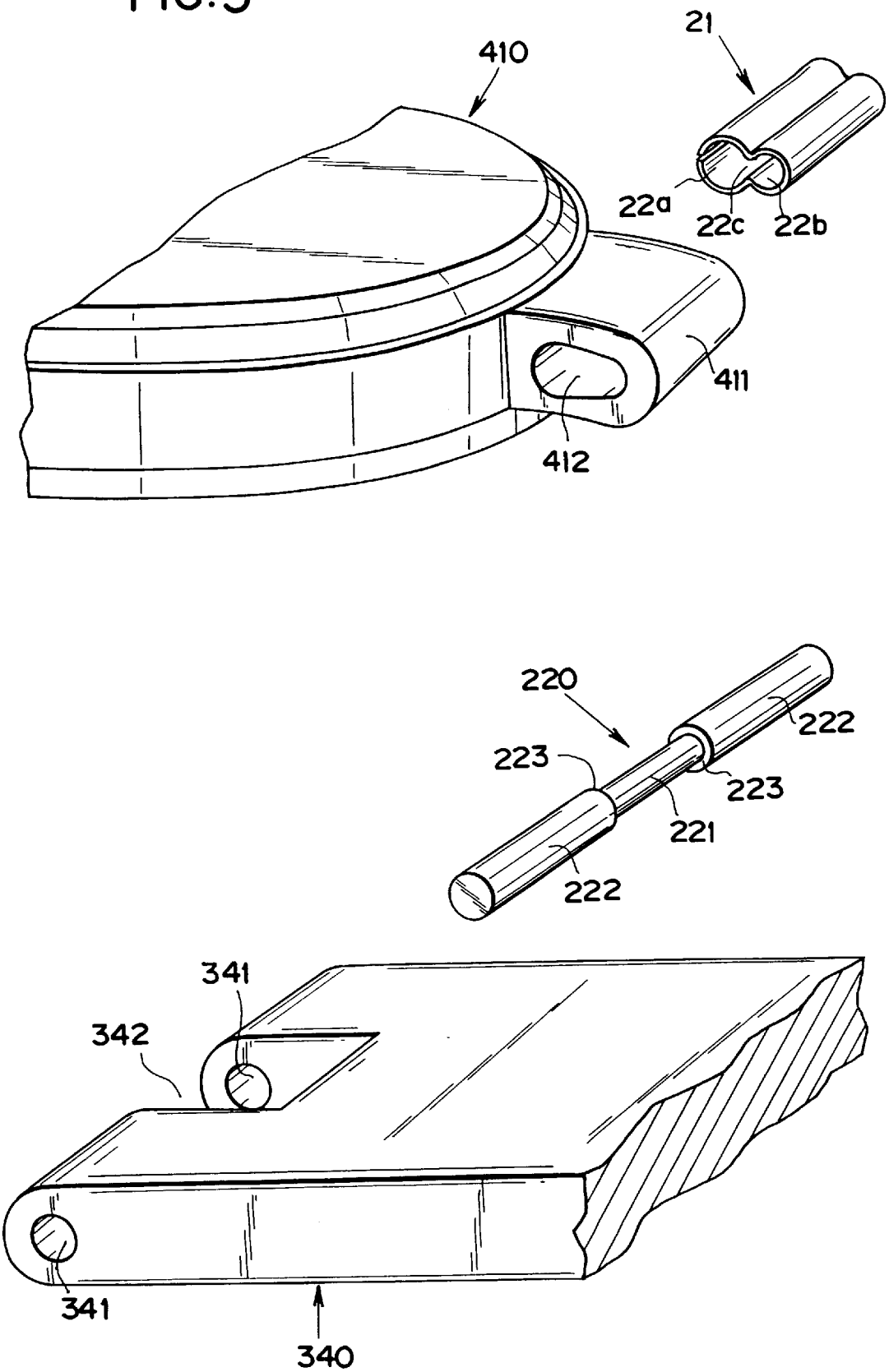
FIG. 5 is an exploded perspective view showing still another embodiment of this invention.

FIG. 5 shows an embodiment for connecting a leather band to a watch having one lug.

The cocoon-shaped ring 21 of this embodiment is made of sheet metal as with the other embodiments described earlier and provided with a larger-diameter bore 22*a*, a smaller-diameter bore 22*b* and a constricted part 22*c*.

The length of the cocoon-shaped ring 21 is substantially equal to the width of the single lug 411 in which it is fitted. The cocoon-shaped ring 21 is inserted in an outwardly constricted through hole bored through the single lug.

A stepped pin 220 has a smaller-diameter part 221 that fits into the cocoon-shaped ring 21 and larger-diameter parts 222 that are formed on both sides thereof and inserted into openings 341 provided in two prongs formed at each end of the leather band 340. Reference numeral 223 denotes an elevation between the smaller-diameter part 221 and the larger-diameter part 222 and reference numeral 342 designates a recess provided between the two prongs at each end of the leather band to accommodate the lug 411.

If pipes or other similar members are fastened in the openings 341 as spacers, insertion of the stepped pin 220 will be facilitated.

This embodiment can be used for connecting the watch casing 410 to not only the leather band 340 but also bands of metals and synthetic resins, such as urethanes and vinyls.

Figure 6:
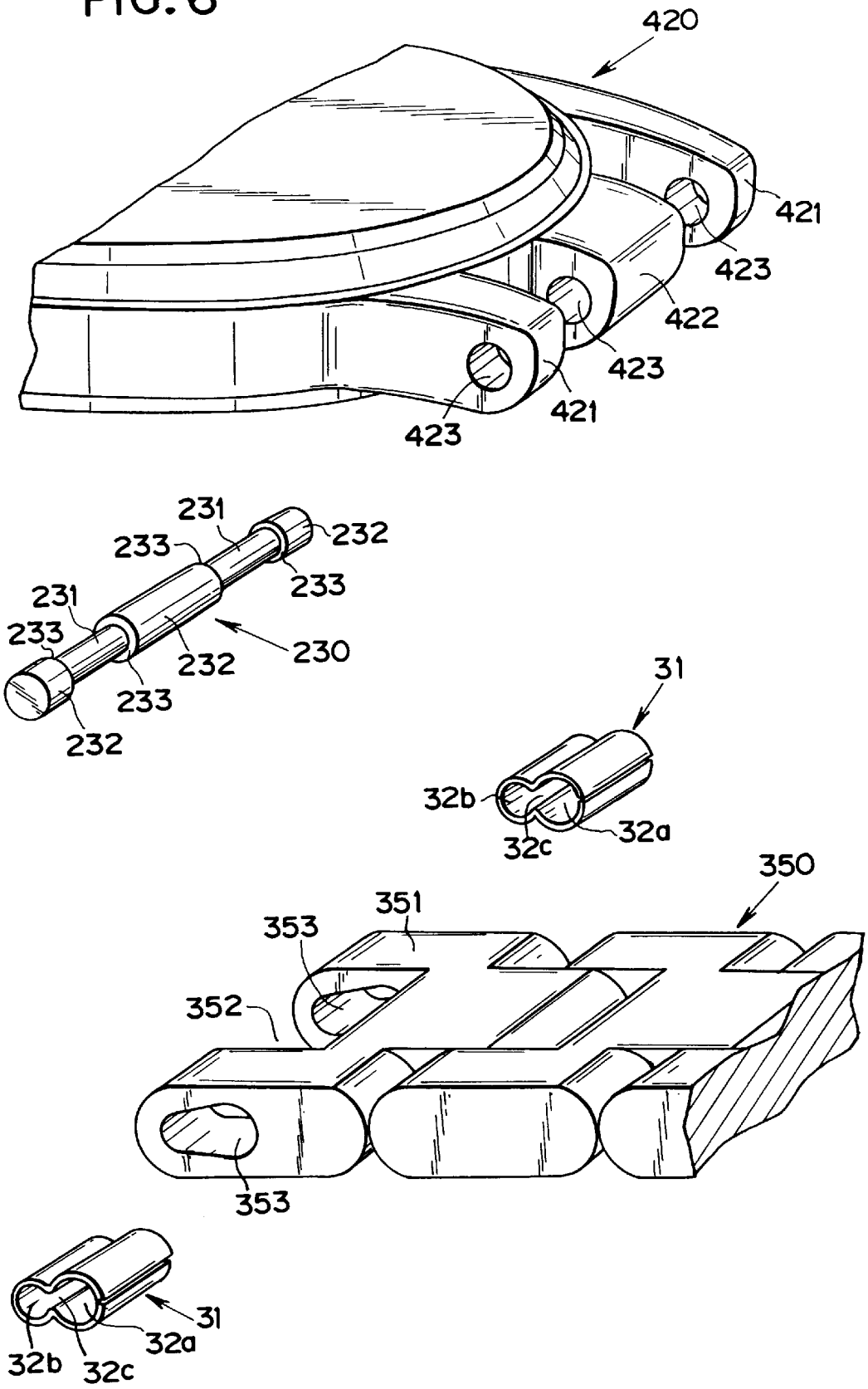
FIG. 6 is an exploded perspective view showing an embodiment of this invention for connecting a watch casing and a solid-metal block band.

FIG. 6 shows an embodiment for connecting a metal band 350 to a toothed lug on a watch casing 420.

A cocoon-shaped ring 31 comprises two rings each having a larger-diameter bore 32*a*, a smaller-diameter bore 32*b*, a constricted part 32*c* and a length substantially equal to the space left between the central tooth 422 and outer teeth 421 and being adapted to be inserted in an opening 353 provided in A stepped pin 230 has larger-diameter parts 232 corresponding to the teeth 421 and 422 and smaller-diameter parts 231 provided between the larger-diameter parts and corresponding to the cocoon-shaped rings 31. The stepped pin 230 is inserted from one side of the watch casting 420 first into an opening 423 in one of the teeth 421 and then into the larger-diameter bore 32*a* in the cocoon-shaped ring 31. By then pulling the metal band 350 in the longitudinal direction, connection between the watch casing 420 and metal band 350 is completed.

This embodiment is applicable to not only metal bands but also to bands of leather, synthetic resins, such as urethanes and vinyls, and clothes.

Figure 7:
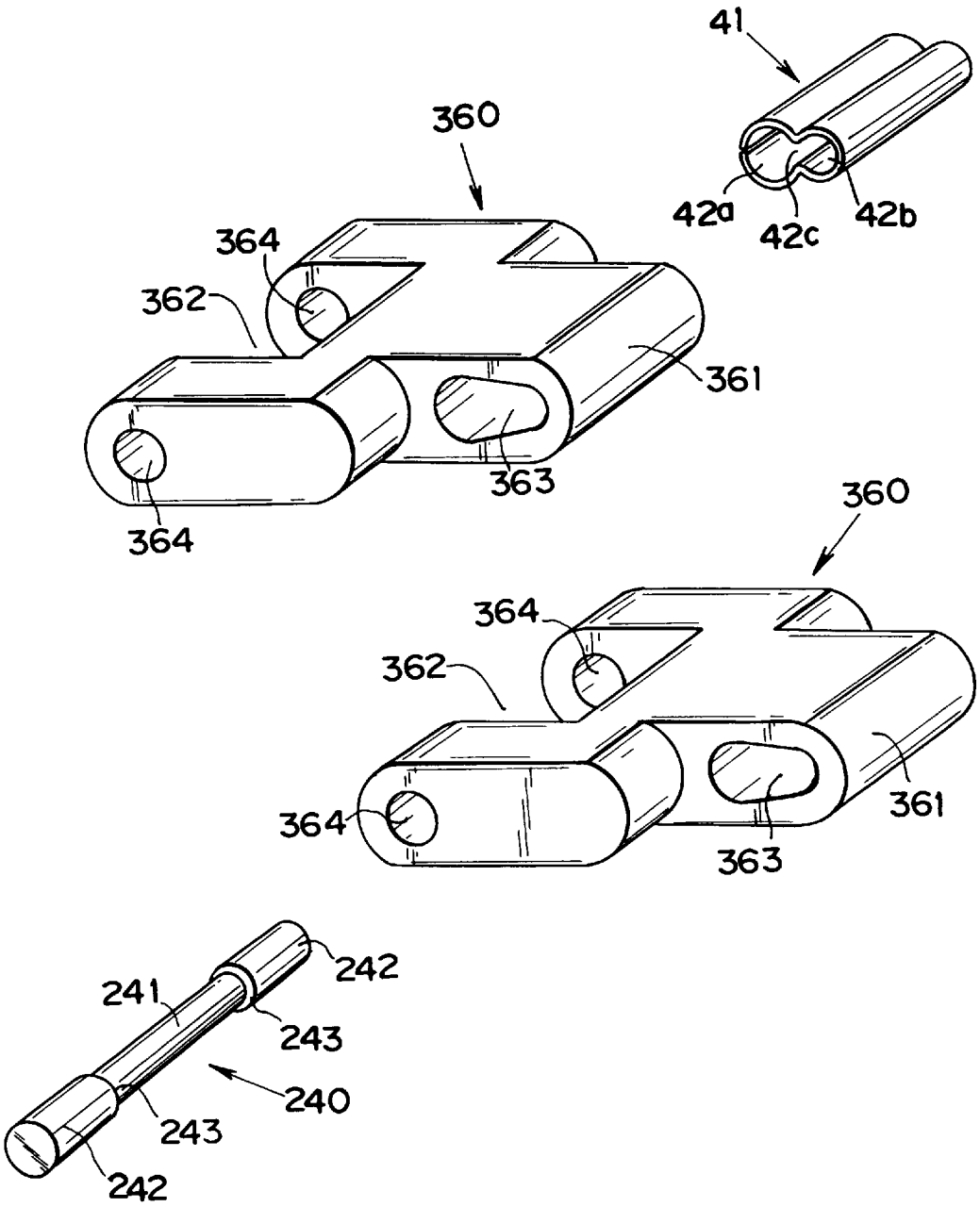
FIG. 7 is an exploded perspective view showing an embodiment of this invention for connecting links of a watch band.

FIG. 7 shows an embodiment for connecting links of a solid block band.

A cocoon-shaped ring 41 of this embodiment is made of sheet metal and has a length substantially equal to the width of a projection 361 on a link 360, a larger-diameter bore 42*a*, a smaller-diameter bore 42*b* and a constricted part 42*c*.

A stepped pin 240 has a length corresponding to the total width of the link, with the center thereof forming a smaller-diameter part 241 having a length corresponding to the width of the projection 361 on the link and both ends thereof forming larger-diameter parts 242 of a size that can be loosely accommodated in a bore 364 provided in each of the links 360.

Each link 360 making up the solid band has a recess 362 at one end of the length thereof and a projection 361 at the other end. Bores 364 to accommodate a pin open to the recess 362, while a bore 36 to accommodate the ring is provided in the projection 361, with the constricted part of the bore directed toward the outer end of the projection.

Two links 360 are connected by placing them in line and fitting the projection 361 of one link into the recess 362 in the other link. After aligning the larger-diameter bore 42*a* in the cocoon-shaped rings 41 fitted in the projections 361 of one link with the bores 364 in the other link, the stepped pin 240 is passed through from one of the bores 364. Assembling is completed when the smaller-diameter part 241 is moved into the smaller-diameter bore 42*b* by resiliently opening up the constricted part 42*c* by pulling away the links 360 in the longitudinal direction thereof.

The cocoon-shaped ring 41 positioned between the elevations 243 of the stepped pin 240 restricts the longitudinal motion of the stepped pin 240. When the watch is on the wrist, tensile force usually acting on the band is conducive to forming a rigid connection between the assembled links 360.

This embodiment is applicable to not only solid metal bands but also bands of semi-solid and wrapped metal, and bands of synthetic resin blocks.

Figure 8:
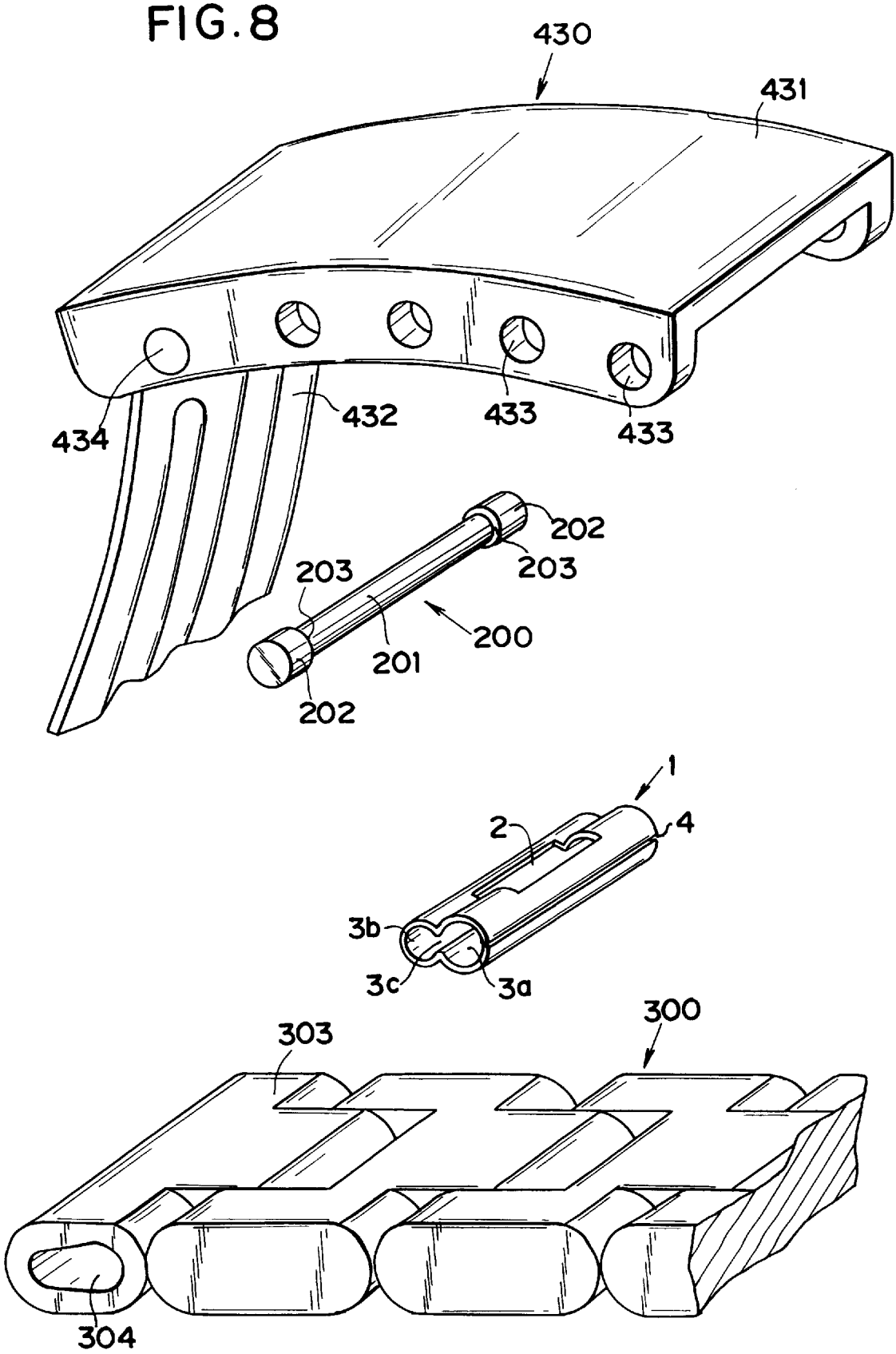
FIG. 8 is an exploded perspective view showing an embodiment of this invention for connecting a three-piece collapsible fastener and a watch band.

FIG. 8 shows an embodiment for connecting a three-piece collapsible fastener to a metal band.

The cocoon-shaped ring 1 of this embodiment is made of sheet metal and has a larger-diameter bore 3*a*, the length thereof corresponding to the total width of a band 300 or more accurately to the total width of a fastener-connecting link 303, a smaller-diameter bore 3*b*, a constricted part 3*c*, and a slot 2.

A pressed pin 200 has a length equal to or somewhat shorter than the total width of the upper case 431 of the collapsible fastener 430, with a smaller-diameter part 201 having a length corresponding to the width of the fastener-connecting link 303 formed in the middle thereof and larger-diameter parts 202 of a size that can be loosely accommodated in adjusting holes 433 provided in the upper case 431 at both ends thereof.

Reference numeral 432 designates a collapsible strip that is connected to the other end of the upper case 431 by means of a pin 434.

This embodiment provides an appearance similar to that of ordinary watches and is also applicable to bands of solid, semi-solid, wrapped and helically wound metal and synthetic resins.

Figure 9A:
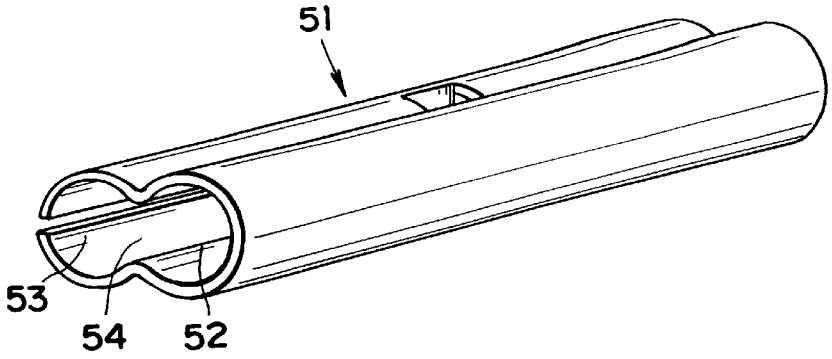
FIGS. 9A to 9C show an embodiment of cocoon-shaped rings according to this invention.
Figure 9B:
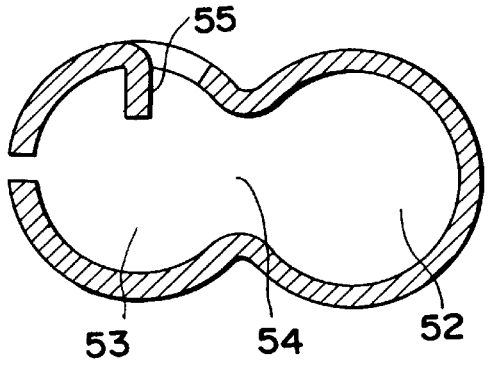
Figure 9C:
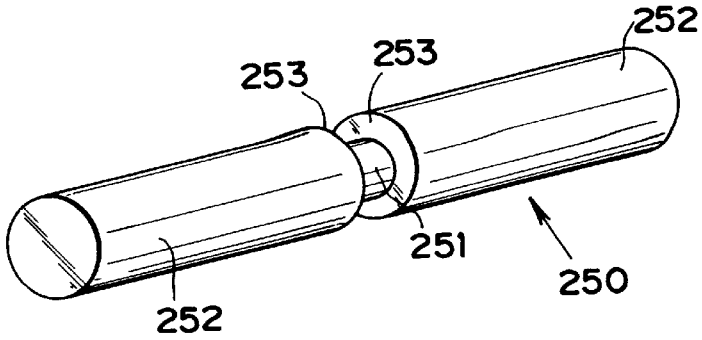
Figure 10A:
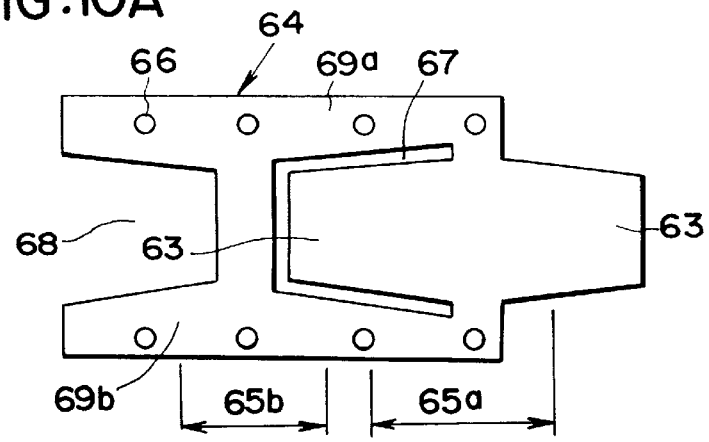
FIGS. 10A to 10D another embodiment of cocoon-shaped rings according to this invention.
Figure 10B:
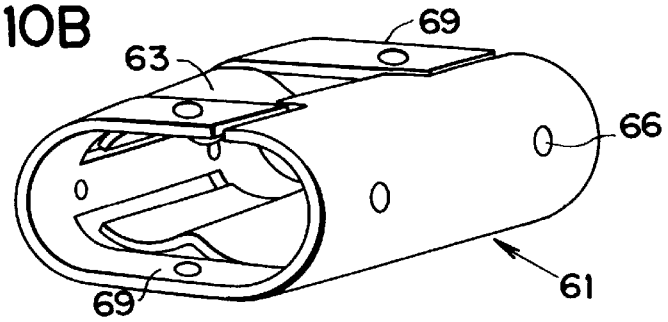
Figure 10C:
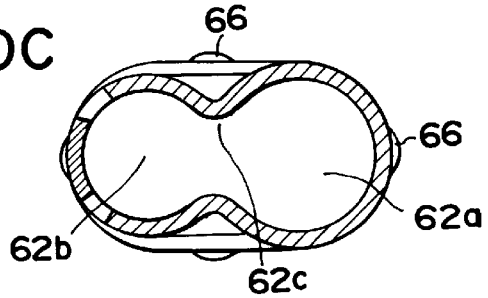
Figure 10D:
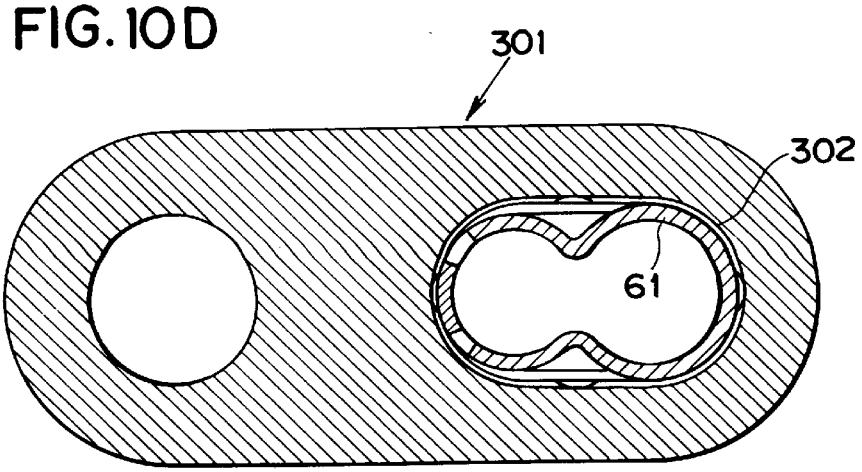

FIGS. 9A to 9C another embodiment of connecting mechanisms according to this invention.

A cocoon-shaped ring 51 of this embodiment is made of sheet metal and has a constricted part 54 with an opening whose width is smaller than larger-diameter parts 252 of a stepped pin 250 and bores 52 and 53 that can accommodate the larger-diameter parts 252 formed on both sides of the constricted part, as shown in FIG. 9A. In the bore 53 of the cocoon-shaped ring 51 is provided an inwardly directed projection 55 that fits in the smaller-diameter part 251 of the stepped pin 250 to restrict the motion thereof, as shown in FIG. 9B. The width of the projection 55 is somewhat smaller than the length of the smaller-diameter part 251 of the stepped pin 250.

To engage the stepped pin 250 with the cocoon-shaped ring 51, as shown in FIG. 9C, the stepped pin 250 is inserted into the bore 52 without the inwardly directed projection 55 from one end thereof. When the larger-diameter part 252 is moved into the bore 53 with the inwardly directed projection 55 by resiliently opening up the constricted part 54, the projection 55 fits between the elevations 253 at both ends of the smaller-diameter part 251, thereby restricting the longitudinal motion of the stepped pin 250.

FIGS. 10A to 10D show another embodiment of cocoon-shaped rings. At A is shown an exploded view of a sheet metal 61 that is formed into a cocoon-shaped ring 61 which comprises a zone 65*b*, shown in the left half, that forms a smaller-diameter bore 62*b* and a zone 65*a*, shown in the right half, that forms a larger-diameter bore 62*a*. In the zone 65*a* are formed trapezoidal pieces 63 that are formed into constricted parts whose width is somewhat smaller than the length of the smaller-diameter part of the stepped pin. The tapered end of one of the symmetrically provided pieces 63 is directed outward, whereas that of the other is directed inward and surrounded by a stamped slit 67. A recess 68 to accommodate one of the pieces 63 is formed in the zone 65*b* that forms the smaller-diameter bore.

To form a cocoon-shaped ring 61 from the sheet 64, the left and right edges 69*b* and 69*a* are cylindrically bent as shown at B and C of FIG. 10, with the middle of the paired pieces 63 angularly bent inward, thus forming the smaller- and larger-diameter bores 62*b* and 62*a*. A constricted part 62*c* whose opening is smaller than the sum of the radii of the larger- and smaller-diameter parts of the stepped pin is formed between the bores 62*a* and 62*b*.

The cocoon-shaped ring 61 thus formed is fit in a bore 302 provided in an end piece 301 by means of engaging projections 66 provided thereon, as shown at D.

Figure 11:
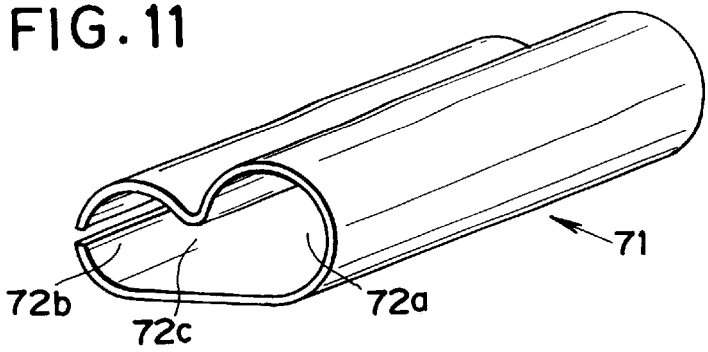
FIG. 11 is a view showing another embodiment of cocoon-shaped rings.

FIG. 11 shows a two-bore half-round ring 71 of sheet metal comprising a larger-diameter bore 72*a*, a smaller-diameter bore 72*b*, and a constricted part 72*c*. In other respects, this half-round ring 71 is similar to the cocoon-shaped rings shown in FIGS. 1 to 8.

Figure 12A:
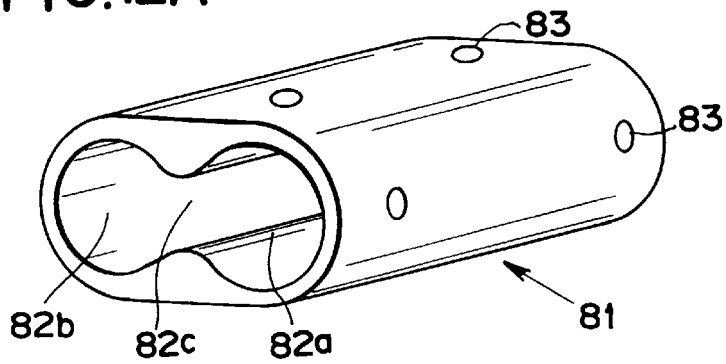
FIGS. 12A to 12C show still another embodiment of cocoon-shaped rings.
Figure 12B:
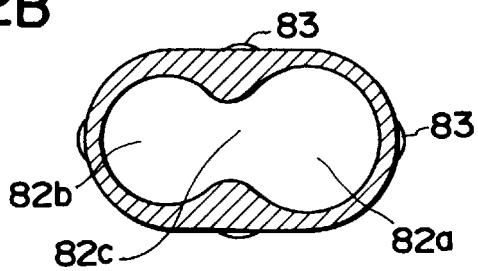
Figure 12C:
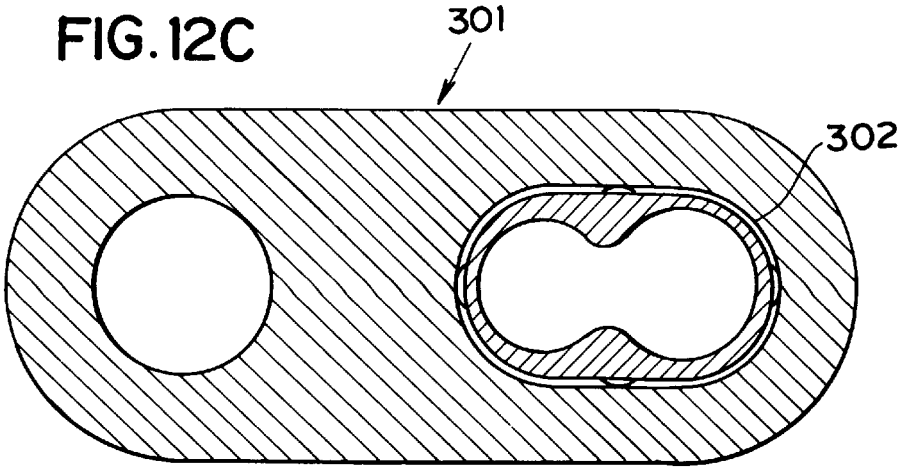

FIGS. 12A to 12C a cocoon-shaped ring 81 integrally formed of ABS synthetic resin which comprises a larger-diameter bore 82*a*, a smaller-diameter bore 82*b* and a constricted part 82*c*, with engaging projections 83 formed therearound.

The cocoon-shaped ring 81 is resiliently fitted in a bore 302 in an end piece 301 by means of the engaging projections 83.

The cocoon-shaped ring 81 may also be made of polyacetals, urethanes and other synthetic resins.

FIGS. 13A to 13E show another embodiment of this invention having a G-shaped smaller bore.

A substantially elliptically shaped ring of sheet metal has a larger-diameter bore 92*a* to accommodate a larger-diameter part 242 of a stepped pin 240 and a smaller-diameter part 92*b* having a cylindrically bent G-shaped ring 93 formed in the middle thereof. The width of the G-shaped ring is somewhat smaller than the length of a smaller-diameter part 241 of the stepped pin 240. A constricted part 92*c* whose opening is smaller than the sum of the radii of the larger- and smaller-diameter parts 242 and 241 is formed by angularly bending inward the leading edge 97 that extends to the border with the larger-diameter bore 92*a*.

Figure 13A:
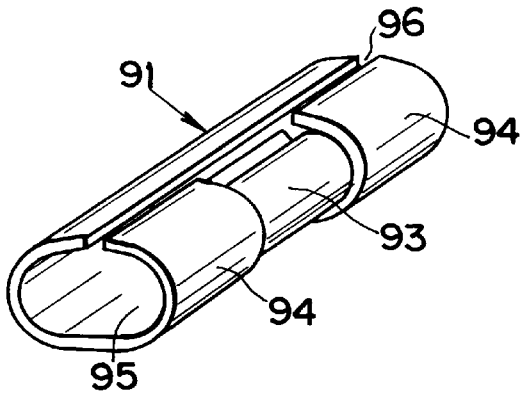
FIGS. 13A to 13E show yet another embodiment of cocoon-shaped rings.
Figure 13B:
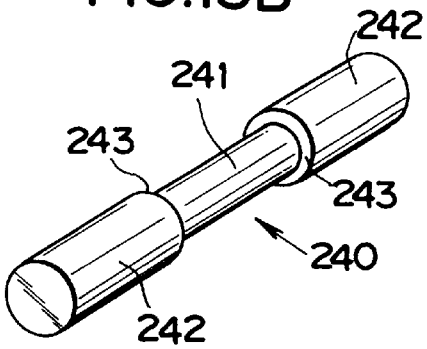
Figure 13C:
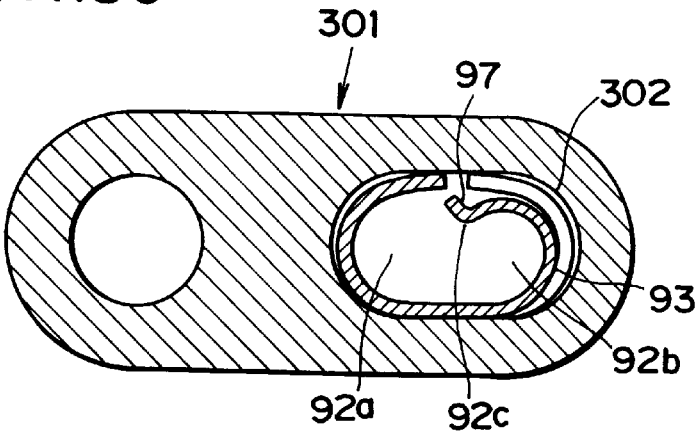
Figure 13D:
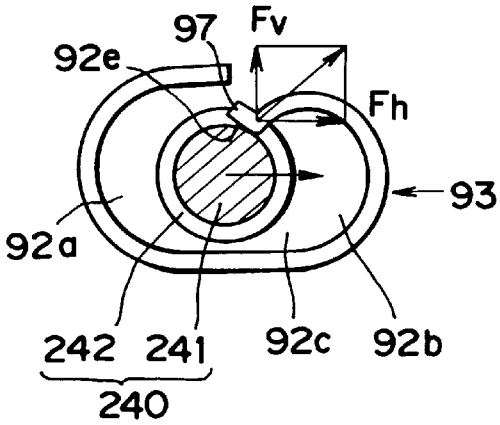

The constricted parts of the embodiment described earlier give a click when they resiliently return to their original position after the stepped pin has moved into the smaller-diameter bore thereof and, at the same time, prevent the stepped pin from moving back to the large-diameter bore from the smaller-diameter bore. By comparison, the constricted part 92 of this embodiment is shaped like a cantilever at the leading edge 97, as shown in FIG. 13D. When the stepped pin 240 is moved from the larger-diameter bore 92*a* to the smaller-diameter bore 92*b*, a vertical component of force Fv and a horizontal component of force Fh act on the leading edge 97, whereby the G-shaped ring 93 is elastically deformed both vertically and horizontally.

With this embodiment, therefore, the magnitude of the horizontal component of force Fh can be varied by varying the angle of bend of the constricted part 92*e*. This, in turn, permits moving the stepped pin 240 into the smaller-diameter bore 92*b* with a desired amount of force. For instance, the motion can be achieved with a force of 0.5 to 1.5 kgs that is not too much even for women and children.

Figure 13E:
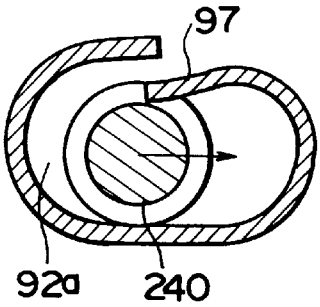
Figure 14A:
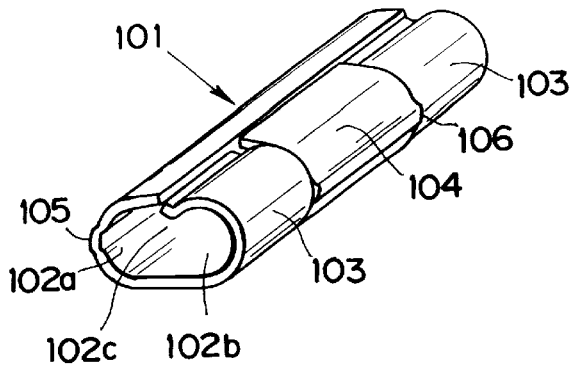
FIGS. 14A to 14D show an embodiment of cocoon-shaped rings.
Figure 14B:
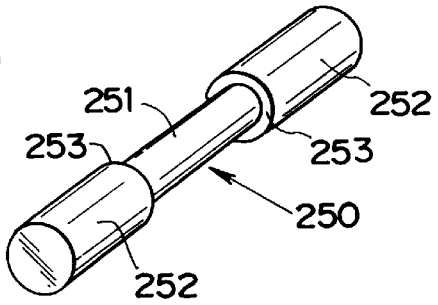
Figure 14C:
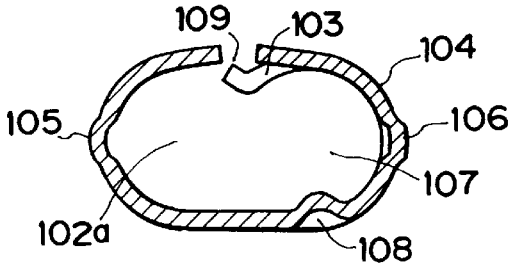
Figure 14D:
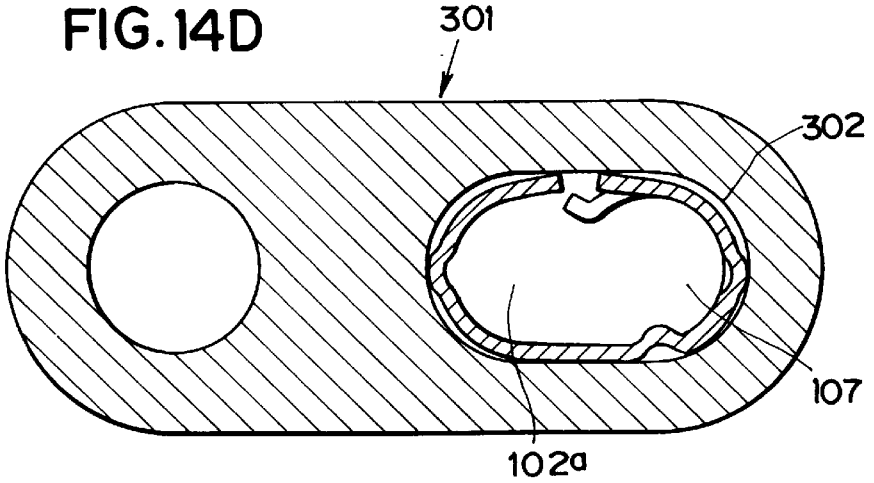
Figure 15A:
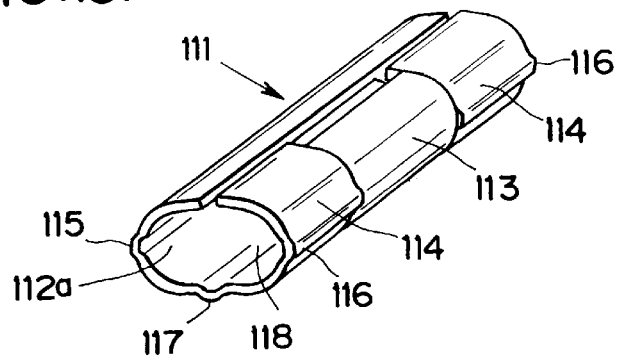
FIGS. 15A to 15D show another embodiment of cocoon-shaped rings.
Figure 15B:
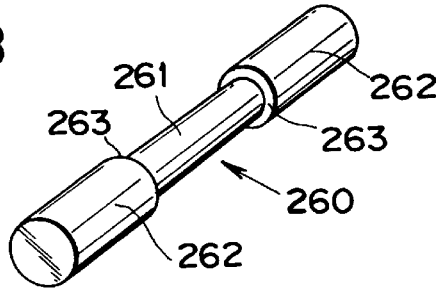
Figure 15C:
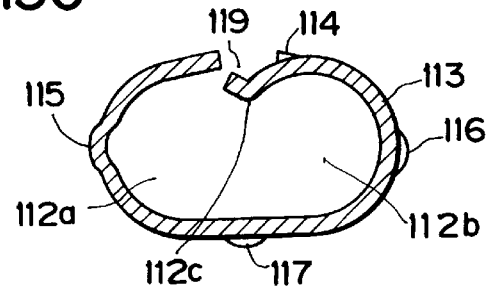
Figure 15D:
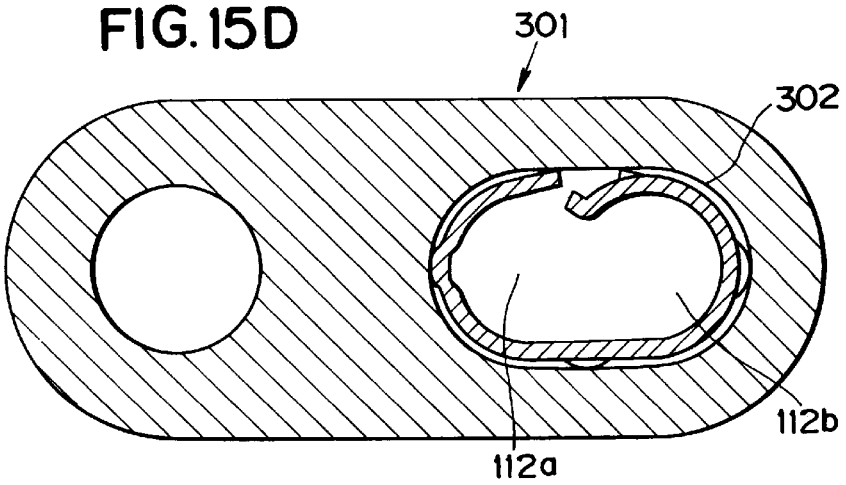

The leading edge 97 may also be bent gently down toward the larger-diameter bore 92*a* as shown in FIG. 13E. In this type of embodiment, it is necessary to secure a space to insert the stepped pin 240 by limiting the projection of the leading edge into the larger-diameter bore 92*a*.

The cocoon-shaped ring 91 thus formed is resiliently held in a bore 302 in an end piece 301 by means of the elastic force of the sheet metal to return to its original condition. The G-shaped ring 93, which is positioned on the inner side of the non-G-shaped part 94, does not come into contact with the inner wall of the bore 302 even when elastically deformed by the insertion of the stepped pin 240. Accordingly, no excessive force acts on the G-shaped ring 93.

FIGS. 14A to 14D show a cocoon-shaped ring 101 formed by bending sheet metal into a substantially elliptical form. One half of the ring is formed into a larger-diameter bore 102*a* to accommodate a larger-diameter part 252 of a stepped pin 250, whereas the other half is formed into a bore 107 to accommodate the larger-diameter part 252 of the stepped pin 250 that has G-shaped rings 103, with the leading edge thereof angularly bent inward, on both sides thereof. A non-G-shaped part 104 is formed between the G-shaped rings 103. The width of the non-G-shaped part is somewhat smaller than the length of the smaller-diameter part 251 of the stepped pin 250. A projection 108 that fits between the elevations 253 on the stepped pin 250 to restrict the motion thereof is formed in a portion thereof.

Reference numerals 105 and 106 denote engaging projections formed on the surface of both ends of the cocoon-shaped ring 101 that permit resilient engagement into the bore 302 in the end piece 301.

To achieve engagement with the cocoon-shaped ring 101, the stepped pin 250 is first inserted in the larger-diameter bore 102*a*. Then, the larger-diameter part 252 of the stepped pin is moved into the bore 107 by resiliently opening up the constricted part 102*c*. The projection 108 that then fits between the elevations 253 on the stepped pin 250 restricts the longitudinal motion thereof.

Positioned on the inner side of the engaging projection 106, the G-shaped ring 103 does not come into contact with the inner wall of the bore 302 even when elastic deformation results from the insertion of the stepped pin 250. Therefore, no excessive force acts on the G-shaped ring 103.

FIGS. 15A to 15D show a cocoon-shaped ring 111 that comprises a larger-diameter bore 112*a* on one side thereof. Larger-diameter bores 118 on the other side are formed by non-G-shaped rings 114 at both ends of the ring 111, with a G-shaped ring 113 in the middle forming a smaller-diameter bore 112*b* and a constricted part 112*c*. Engaging projections 115, 116 and 117 are formed on the outer surface of the non-G-shaped rings 114 to allow the resilient engagement of the ring 111 in a bore 302 provided in an end piece 301.

Figure 16A:
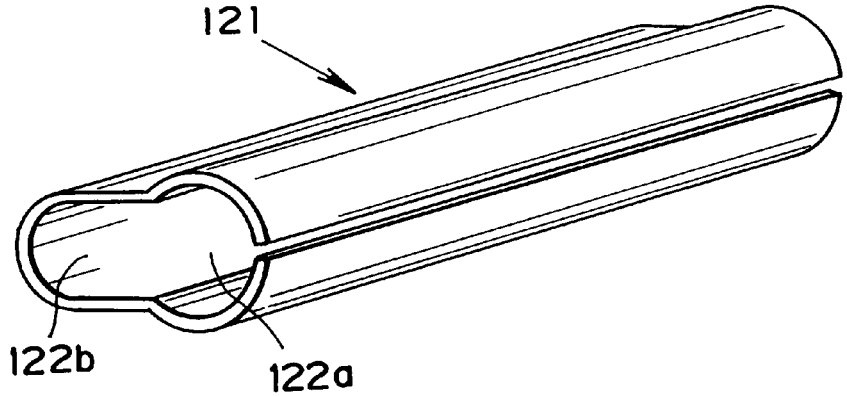
FIGS. 16A to 16C show still another embodiment of cocoon-shaped rings.
Figure 16B:
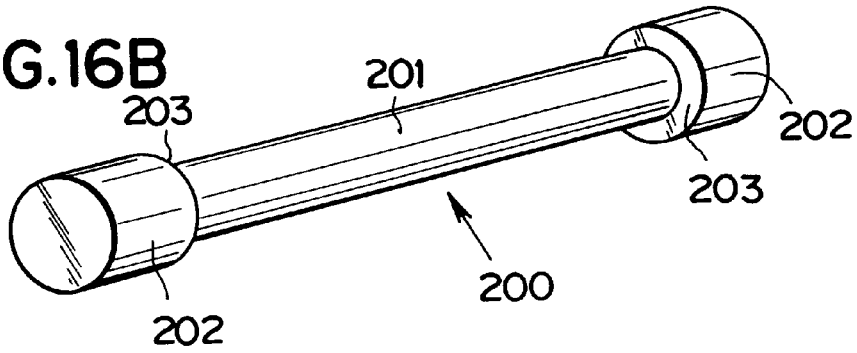
Figure 16C:
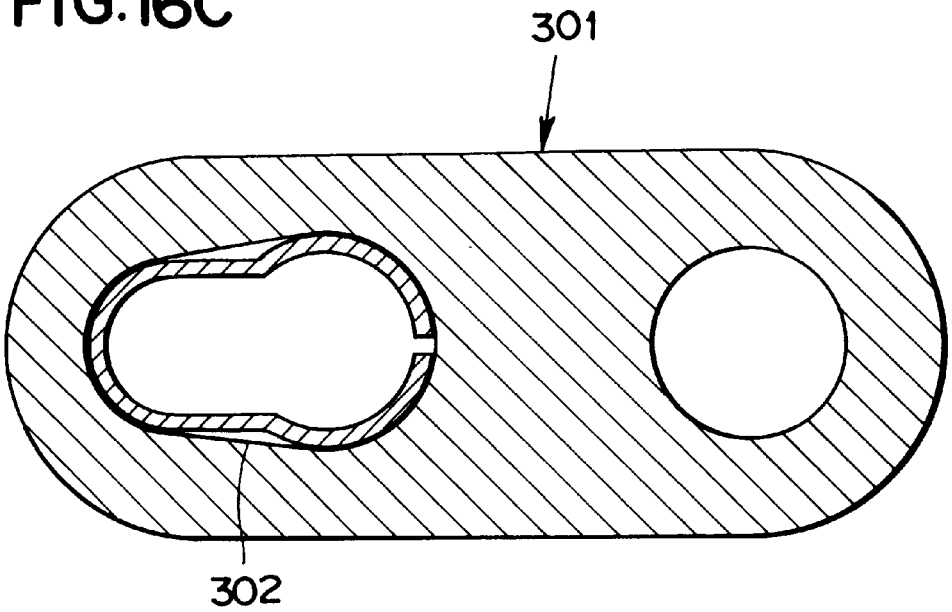

FIGS. 16A to 16C show yet another embodiment of this invention that comprises a cocoon-shaped ring 121 of resilient sheet metal. A large-diameter bore 122*a* and a smaller-diameter bore 122*b* are formed on both sides of a connecting space whose inside diameter is identical with the diameter of a smaller-diameter part 201 of a stepped pin 200.

When fitted in a bore 302 provided in an end piece 301, the cocoon-shaped ring 121 has an inward elasticity. Therefore, the elasticity of the sheet metal holds the smaller-diameter part 201 in place when the stepped pin 200 inserted in the larger-diameter bore 122*a* is further pressed into the smaller-diameter bore 122*b*.

The cocoon-shaped ring 121 may be integrally formed at an end of a urethane band 330, as described with reference to FIG. 4 and is also applicable to bands of such synthetic resins as ABS and polyacetal resins.

As many apparently widely different embodiments of this invention may be made without departing from the spirit and scope thereof, it should be understood that the invention is not limited to the specific embodiments thereof except as defined in the appended claims.

What is claimed is:

1. A mechanism for connecting ornamental parts of a wrist watch comprising:

a stepped pin having at least two larger-diameter parts at opposed ends thereof and a smaller-diameter part between said larger-diameter parts to connect together the ornamental parts of the wrist watch; and a tubular ring that is cocoon-shaped in cross-section, adapted to be disposed within at least one of the ornamental parts and parallel to the width of the ornamental part, and having a constricted part that resiliently alters the shape to allow the smaller-diameter part of the stepped pin to pass there through, a larger-diameter bore to admit the larger-diameter parts of the stepped pin provided on one side of the constricted part, and a smaller-diameter bore that is provided on the other side of the constricted part for holding the stepped pin parallel to the width of the ornamental part.

2. A mechanism for connecting ornamental parts of a wrist watch according to claim 1, in which the at least one ornamental part has at least two ends, at least one of the ends being adapted to be a free end, the cocoon-shaped ring being provided at an end of the ornamental part with the smaller-diameter bore being disposed closer to the free end thereof than the larger-diameter bore.

3. A mechanism for connecting ornamental parts of a wrist watch according to claim 1, in which the cocoon-shaped ring is formed of a sheet of resilient material.

4. A mechanism for connecting ornamental parts of a wrist watch according to claim 1, in which the cocoon-shaped ring is made of a unitary piece of synthetic resin.

5. A mechanism for connecting ornamental parts of a wrist watch according to claim 1, in which the cocoon-shaped ring is made of a sheet-shaped member so as to be admissible in a bore provided at an end of the at least one of the ornamental parts.

6. A mechanism for connecting ornamental parts of a wrist watch according to claim 1, in which the smaller-diameter bore whose diameter is somewhat smaller than the diameter of the smaller-diameter part of the stepped pin is provided in the middle of the width of the cocoon-shaped ring.

7. A mechanism for connecting ornamental parts of a wrist watch according to claim 6, in which the constricted part is formed by bending inward a portion of the cocoon-shaped ring the sheet-shaped member having smaller-diameter bore in the middle of the width thereof.

8. A mechanism for connecting ornamental parts of a wrist watch according to claim 1, in which the constricted part is formed by bending inward a portion of the cocoon-shaped ring.

9. A mechanism for connecting ornamental parts of a wrist watch according to claim 1, in which the cocoon-shaped ring is formed by a member whose width is slightly smaller than the diameter of the smaller-diameter part of the stepped pin.

10. A mechanism for connecting ornamental parts of a wrist watch according to claim 1, in which the cocoon-shaped ring has two semi-circular parts on both sides of the constricted part thereof, one of which forming the larger-diameter bore capable of accommodating the larger-diameter part of the stepped pin and the other of which forming the smaller-diameter bore capable of accommodating the smaller diameter part of the stepped pin.

11. A mechanism for connecting ornamental parts of a wrist watch according to claim 1, in which multiple projections adapted to resiliently come into contact with the ornamental parts are formed on the outer surface of the cocoon-shaped ring.

12. A mechanism for connecting ornamental parts of a wrist watch according to claim 1, in which the cocoon-shaped ring is made of a sheet-shaped member, with an end thereof bent inward to form the constricted part.

13. A mechanism for connecting ornamental parts of a wrist watch according to claim 1, in which the cocoon-shaped ring is made of a sheet-shaped member, with the middle of the width thereof bent inward to form the constricted part.

14. The mechanism for connecting ornamental parts of a wrist watch according to claim 1, wherein the diameter of the smaller-diameter bore is smaller than the diameter of the smaller-diameter part, said larger-diameter parts coming in contact with said ring to restrict the motion of the stepped pin through the smaller-diameter bore.

15. The mechanism for connecting ornamental parts of a wrist watch according to claim 1, further comprising a cocoon-shaped spacer, said cocoon-shaped ring being inserted into the cocoon-shaped spacer.

16. The mechanism for connecting ornamental parts of claim 1, wherein an end of the ring is bent inward to form the constricted part.

17. A structure for connecting ornamental parts of a wrist watch comprising:

a stepped pin for connecting together the ornamental parts of the wrist watch, the stepped pin having two ends, at least one smaller-diameter portion along its length, and larger-diameter parts formed at each end of the stepped pin, the smaller-diameter portion being disposed between said larger-diameter parts; and tubular means having a cocoon-shape in cross-section adapted to be disposed within at least one of the ornamental parts to admit and hold the stepped pin, said means having a constricted part that allows the passage of the smaller-diameter portion of said stepped pin by resiliently altering the shape thereof, a first bore admitting said stepped pin provided on one side of the constricted part, and a second bore on another side of the constricted part admitting said smaller-diameter portion and restricting axial motion of the stepped pin parallel to the width of the ornamental part by coming into contact with each of said larger-diameter parts.

18. A structure for connecting ornamental parts of a wrist watch according to claim 17, in which a friction fit is formed between the tubular means to admit and hold the stepped pin and a third bore provided in one of the ornamental parts.

19. A structure for connecting ornamental parts of a wrist watch according to claim 17, in which the means includes a bore having a cocoon-shaped cross-section formed in the ornamental part, the bore comprising a larger-diameter bore large enough to admit the larger-diameter part of said stepped pin that is provided on one side of the constricted part and a smaller-diameter bore of a width somewhat smaller than the length of the smaller-diameter portion of said stepped pin, and a diameter large enough to permit the admission thereof, the smaller diameter portion being provided on the other side of the constricted part.

20. A structure for connecting ornamental parts of a wrist watch according to claim 17, wherein said means includes a bore having a cocoon-shaped cross-section formed in the ornamental part, the bore comprising a first bore-portion large enough to admit the larger-diameter part of said stepped pin that is provided on one side of the constricted part that resiliently alters its shape, and a second bore portion large enough to admit the smaller-diameter portion of said stepped pin and having an inwardly projecting part to restrict the axial motion of said stepped pin, the width of the inwardly projecting part being somewhat smaller than the length of the smaller-diameter portion of said stepped pin, the second bore portion being provided on the other side of the constricted part.

21. A structure for connecting ornamental parts of a wrist watch according to claim 17, wherein said constricted part includes an inwardly projecting part of a length somewhat smaller than the length of the smaller-diameter portion of the stepped pin.

22. A structure for connecting ornamental parts of a wrist watch comprising a stepped pin for connecting together the ornamental parts of the wrist watch, the stepped pin having two ends, at least one smaller-diameter portion along its length, and larger-diameter parts formed at each end of the stepped pin, the smaller-diameter portion being disposed between said larger-diameter parts; means having a cocoon-shape in cross-section adapted to be disposed within at least one of the ornamental parts to admit and hold the stepped pin, said means having a constricted part that allows the passage of the smaller-diameter portion of said stepped pin by resiliently altering the shape thereof, a first bore admitting said stepped pin provided on one side of the constricted part, and a second bore on another side of the constricted part admitting said smaller-diameter portion and restricting axial motion of the stepped pin parallel to the width of the ornamental part by coming into contact with each of said larger-diameter parts, said means including a tubular ring made of an elastic sheet and having a cocoon-shaped cross-section, the ring including said first bore, said first bore admitting the larger-diameter parts of said stepped pin and the second bore, the second bore having a length smaller than the length of the smaller-diameter portion of said stepped pin and a diameter large enough to permit the admission thereof.

* * * * *